US009796072B2

(12) United States Patent
Young

(10) Patent No.: US 9,796,072 B2
(45) Date of Patent: Oct. 24, 2017

(54) STAPLE TOOL

(71) Applicant: ILLINOIS TOOL WORKS INC., Glenview, IL (US)

(72) Inventor: Graeme Young, Hamilton (NZ)

(73) Assignee: Illinois Tool Works Inc., Glenview, IL (US)

( * ) Notice: Subject to any disclaimer, the term of this patent is extended or adjusted under 35 U.S.C. 154(b) by 847 days.

(21) Appl. No.: 14/014,733

(22) Filed: Aug. 30, 2013

(65) Prior Publication Data

US 2015/0060513 A1 Mar. 5, 2015

(51) Int. Cl.

| | |
|---|---|
| ***B25C 1/00*** | (2006.01) |
| ***B25C 5/00*** | (2006.01) |
| ***B25C 5/16*** | (2006.01) |
| ***B25C 5/06*** | (2006.01) |
| ***B25C 1/04*** | (2006.01) |

(52) U.S. Cl.
CPC ..... *B25C 5/06* (2013.01); *B25C 1/047* (2013.01); *B25C 5/16* (2013.01)

(58) Field of Classification Search
CPC ..... B25C 1/00; B25C 1/005
USPC ..... 227/139, 123
See application file for complete search history.

(56) References Cited

U.S. PATENT DOCUMENTS 3,510,043 A * 5/1970 Larson ..... B25C 5/1658 227/109
3,618,447 A 11/1971 Goins
3,757,629 A * 9/1973 Schneider ..... F16B 15/0015 227/83
3,840,165 A * 10/1974 Howard ..... B25C 5/16 227/1

(Continued)

FOREIGN PATENT DOCUMENTS

DE 19 30 490 12/1970
DE 101 09 962 9/2002

(Continued)

OTHER PUBLICATIONS

International Search Report and Written Opinion for International Application No. PCT/US2014/047493, mailed Oct. 22, 2014 (12 pages).

(Continued)

*Primary Examiner* — Andrew M Tecco
*Assistant Examiner* — Praachi M Pathak
(74) *Attorney, Agent, or Firm* — Neal, Gerber & Eisenberg LLP

(57) ABSTRACT

Disclosed is a tool for driving a barbed staple into a workpiece, the tool includes a housing enclosing a power delivery source and a driver blade driven by the power delivery source and comprising an engagement portion configured for engagement with the staple. The tool further includes a nosepiece comprising an aperture providing access for loading a staple into the nosepiece and a passage (Continued)

configured for slidable mounting of the driver blade. In use, the driver blade may be driven along a longitudinal axis of the passage by the power delivery source to engage and drive a staple into a workpiece. Clearances are providing to allow for loading and passage of the barbed staples in the nosepiece and arrangements are provided to maintain the alignment of the staple in the nosepiece to compensate for those clearances.

11 Claims, 3 Drawing Sheets

(56) References Cited

U.S. PATENT DOCUMENTS

| | | | | |
|---|---|---|---|---|
| 3,855,688 | A * | 12/1974 | Knohl | B25C 5/0257 227/109 |
| 4,220,070 | A * | 9/1980 | Anstett | F16B 15/08 411/444 |
| 4,470,531 | A * | 9/1984 | Anstett | F16B 15/0023 227/116 |
| 4,621,758 | A * | 11/1986 | Anstett | B25C 5/11 227/109 |
| 4,697,045 | A | 9/1987 | Beatty | |
| 5,884,829 | A * | 3/1999 | Wingert | B25C 1/008 227/109 |
| 6,071,053 | A * | 6/2000 | Kuhns | B25C 5/06 206/345 |
| 6,915,937 | B2 | 7/2005 | Lat et al. | |
| 6,957,756 | B2 | 10/2005 | Lat et al. | |
| 7,918,374 | B2 | 4/2011 | Gardner et al. | |
| 8,007,512 | B2 * | 8/2011 | Ginn | A61B 17/0057 606/139 |
| 8,728,098 | B2 * | 5/2014 | Daniel | A61B 17/0401 606/143 |
| 8,728,099 | B2 * | 5/2014 | Cohn | A61B 17/1285 606/143 |
| 8,894,669 | B2 * | 11/2014 | Nering | A61B 17/064 606/151 |
| 9,055,945 | B2 * | 6/2015 | Miksza | A61B 17/08 |
| 9,107,661 | B2 * | 8/2015 | Euteneuer | A61B 17/0642 |
| 9,125,650 | B2 * | 9/2015 | Euteneuer | A61F 2/0811 |
| 2003/0021655 | A1 | 1/2003 | Correll | |
| 2004/0262461 | A1 * | 12/2004 | Del Re | H02G 3/32 248/71 |
| 2005/0145666 | A1 * | 7/2005 | Lat | B25C 5/00 227/119 |
| 2008/0179371 | A1 | 7/2008 | Gardner et al. | |
| 2010/0312275 | A1 * | 12/2010 | Euteneuer | A61B 17/0642 606/219 |
| 2011/0079627 | A1 * | 4/2011 | Cardinale | A61B 17/0642 227/176.1 |
| 2013/0153628 | A1 * | 6/2013 | Euteneuer | A61B 17/0642 227/175.1 |
| 2015/0063949 | A1 * | 3/2015 | Young | F16B 15/0015 411/442 |

FOREIGN PATENT DOCUMENTS

| | | |
|---|---|---|
| DE | 103 58 442 | 7/2005 |
| DE | 20 2005 008988 | 5/2006 |
| DE | 10 2011 013292 | 9/2012 |
| DE | 202013006362 | 8/2013 |
| EP | 0 798 503 | 10/1997 |
| EP | 0 798 503 | 6/2002 |
| EP | 1 364 750 | 11/2003 |
| WO | WO 2012/169734 | 12/2012 |

OTHER PUBLICATIONS

Canadian Office Action for Canadian Application No. 2,919,789, dated Dec. 19, 2016 (3 pages).

AB Custom Fencing and Animal Management Systems—Stock-ade ST 400 [retrieved from the Internet on Apr. 20, 2017], <URL: Https://web.archive.org/20130807232321/http://abcustomfencing.com/Stock -ade-ST400.html> published Aug. 7, 2013 as per Wayback Machine.

Australian Innovation Patent Examination Report No. 1 for Australian Application No. 2016100224, dated Apr. 21, 2016 (2 pages).

Australian Innovation Patent Examination Report No. 2 for Australian Application No. 2016100224, dated Aug. 9, 2016 (6 pages).

Australian Innovation Patent Examination Report No. 3 for Australian Application No. 2016100224, dated Sep. 28, 2016 (3 pages).

Australian Innovation Patent Examination Report No. 1 for Australian Application No. 2013222021, dated Aug. 26, 2016 (6 pages).

Australian Innovation Patent Examination Report No. 1 for Australian Application No. 2016101470, dated Oct. 24, 2016 (7 pages).

STOCKadeNZ: "Stock-ade ST-400 Fencing Stapler Demo" [viewed on Internet on Apr. 20, 2017], <URL: https://www.youtube.com/watch?v=zX9x2YwKEDk> published on Aug. 5, 2012.

* cited by examiner

STAPLE TOOL

TECHNICAL FIELD

This disclosure relates tools for driving staples into a workpiece and in particular, staples of the type that comprise barbs that may provide increased retention in a workpiece. The disclosure also relates to methods of driving staples into a workpiece and to staple assemblies.

BACKGROUND

Traditionally, staples have been used to attach items to workpieces (e.g. rural posts, wire livestock fences, power poles etc.). Often, such staples are hand driven into the workpiece using a manual tool.

Power tools for driving staples into a workpiece are also known in the art. These generally comprise a driver blade for driving the staple into the workpiece and a nosepiece comprising a passage to guide the staple as it is driven into the workpiece. These power tools can also comprise a magazine which is able to hold an arrangement of collated staples that may be fed into the firing chamber of the nosepiece.

Barbed staples, which comprise barbs extending from the legs of the staples, are also known in the art. The barbs on the staples can allow stronger retainment (i.e. when compared to traditional non-barbed staples) of the staple in a workpiece.

The barbs on such staples meant that they are not suitable for power tools known in the art that are configured for use with non-barbed staples. As such, only manual (i.e. hand driven) tools are presently used for such staples.

The above references to the background art do not constitute an admission that the art forms part of the common general knowledge of a person of ordinary skill in the art. The above references are also not intended to limit the application of the staple tool as disclosed herein.

SUMMARY

Disclosed is a tool for driving a barbed staple into a workpiece, the tool includes a housing enclosing a power delivery source and a driver blade driven by the power delivery source and comprising an engagement portion configured for engagement with the staple. The tool further includes a nosepiece comprising an aperture providing access for loading a staple into the nosepiece and a passage configured for slidable mounting of the driver blade. In use, the driver blade may be driven along a longitudinal axis of the passage by the power delivery source to engage and drive a staple into a workpiece. The nosepiece further comprises at least one space configured to provide clearance in the passage for a barb of the staple when driven by the driver blade.

Also disclosed is a tool for driving a barbed staple into a workpiece, the tool includes a housing enclosing a power delivery source and a driver blade driven by the power delivery source and comprising an engagement portion configured for engagement with the staple. The tool further includes a nosepiece comprising an aperture providing access for loading a staple into the nosepiece and a passage configured for slidable mounting of the driver blade. In use, the driver blade may be driven along a longitudinal axis of the passage by the power delivery source to engage and drive a staple into a workpiece. The engagement portion of the driver blade is configured to provide lateral support to the staple as it is driven along the longitudinal axis of the passage.

BRIEF DESCRIPTION OF THE DRAWINGS

Embodiments will now be described by way of example only, with reference to the accompanying drawings in which.

DETAILED DESCRIPTION

Figure 1A:
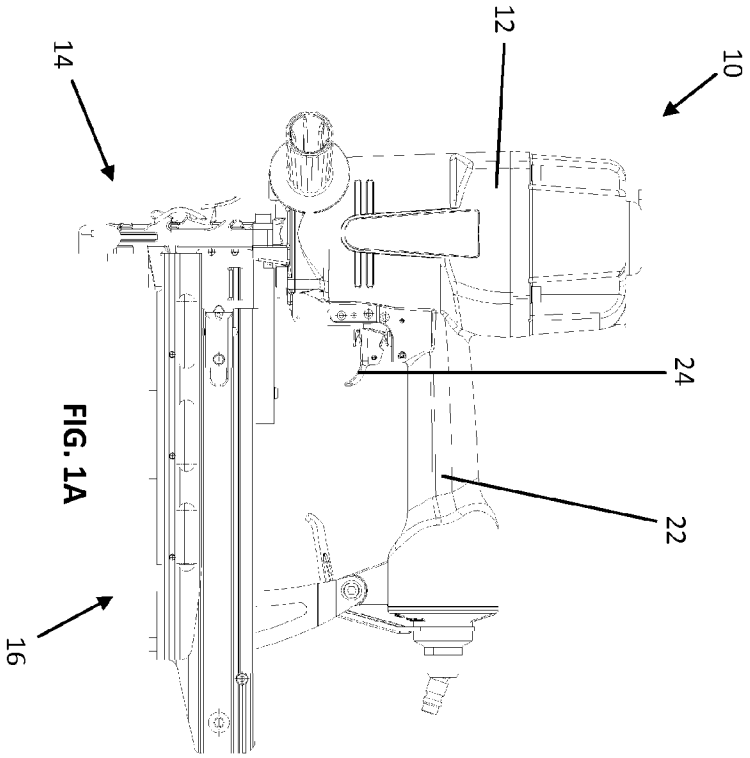
FIGS. 1*a* and 1*b* are side views of an embodiment of a powered staple tool.

In the following detailed description, reference is made to accompanying drawings which form a part of the detailed description. The illustrative embodiments described in the detailed description, depicted in the drawings and defined in the claims, are not intended to be limiting. Other embodiments may be utilised and other changes may be made without departing from the spirit or scope of the subject matter presented. It will be readily understood that the aspects of the present disclosure, as generally described herein and illustrated in the drawings can be arranged, substituted, combined, separated and designed in a wide variety of different configurations, all of which are contemplated in this disclosure.

Disclosed is a tool for driving a barbed staple into a workpiece, the tool comprising: a housing enclosing a power delivery source; a driver blade driven by the power delivery source and comprising an engagement portion configured for engagement with the staple; a nosepiece comprising an aperture providing access for loading a staple into the nosepiece, the nosepiece further comprising a passage configured for slidable mounting of the driver blade; such that, in use, the driver blade may be driven along a longitudinal axis of the passage by the power delivery source to engage and drive a staple into a workpiece; wherein, the nosepiece further comprises at least one space configured to provide clearance in the passage for a barb of the staple when driven by the driver blade.

In some forms, the nosepiece comprises two opposing spaces, the spaces being configured to provide clearance for outwardly facing barbs on respective legs of the staple.

In some forms, the nosepiece comprises at least one lateral passage arranged to provide clearance for a barb of the staple when the staple is being loaded into the nosepiece. In some forms, the nosepiece comprises two opposing lateral passages arranged to provide clearance for outwardly facing barbs on respective legs of the staple.

In some forms, the at least one space is in the form of a channel that extends from the at least one lateral passage to a distal end of the nosepiece.

In some forms, the nosepiece includes wall portions that define a proximal portion of the passage and which are arranged to be in facing relation with an upper portion of respective legs of the staple so as to assist in maintaining correct alignment of the staple in the nosepiece.

In some forms, the engagement portion of the driver blade is configured to provide lateral support to the staple as it is driven along the longitudinal axis of the passage.

Also disclosed is a tool for driving a barbed staple into a workpiece, the tool comprising: a housing enclosing a power delivery source; a driver blade driven by the power delivery source and comprising an engagement portion configured for engagement with the staple; a nosepiece comprising an aperture providing access for loading a staple into the nosepiece, the nosepiece further comprising a passage configured for slidable mounting of the driver blade; such that, in use, the driver blade may be driven along a longitudinal axis of the passage by the power delivery source to engage and drive a staple into a workpiece; wherein the engagement portion of the driver blade is configured to provide lateral support to the staple as it is driven along the longitudinal axis of the passage.

In some forms, the engagement portion of the driver blade is formed such that its profile conforms to the crown of the staple.

In some forms, the driver blade further comprises a guide element configured to resist lateral movement of the driver blade with respect to the longitudinal axis of the passage.

In some forms, the guide element is a ridge formed along the longitudinal axis of the driver blade, the ridge configured for slidable engagement with a corresponding recess in the nosepiece.

In some forms, a workpiece contact element slidably mounted on the nosepiece and configured to retract upon the tool being pressed against a workpiece.

In some forms, the workpiece contact element comprises a groove, the groove aligned such that, in use, when the staple is driven into the workpiece, the legs the staple will be located either side of the groove.

In some forms, the groove is configured for receipt of a fence wire.

In some forms, the power delivery source is pneumatically powered. In an alternative form, the power delivery source is powered by a gas fuel cell. The power delivery source may be in other forms, such as electrically driven for example a cordless battery powered tool.

In some forms, the tool further comprises a staple supply mechanism for supplying staples into the nosepiece through the aperture.

In some forms, the staple supply mechanism is arranged to receive a plurality of collated staples. In some forms, the inside crown of the staples rest and slide along a magazine rail into the nose.

In some forms, the staple supply mechanism comprises a guard arranged to protect a user from contact with the barbs of the staples stored therein.

Also disclosed is a system for driving a barbed staple into a workpiece, the system comprising: a plurality of staples, each staple comprising a crown having two legs extending therefrom, at least one of the staples comprising a barb; and a tool according to any form described above, the tool being arranged to receive individual ones of the plurality of staples into the nosepiece through the aperture to be driven into the workpiece under movement of the driver blade.

In some forms, the plurality of staples is collated when stored in a staple supply mechanism of the tool.

In some forms, the staple assembly comprises at least one strip of collation tape secured to the legs of the staples In some forms, the at least one strip of collation tape is secured at a location on at least one leg of respective ones of the staples between the crowns and barb of the staple.

In some forms, the at least one strip of collation tape is frangible such that upon driving of a staple by the driver blade, the at least one strip of collation tape is broken and the staple separated from the remaining collated staples.

In some forms, the at least one strip of collation tape is broken during driving of the staple, a portion of the at least one strip of collation tape remains on the staple.

In some forms, the portion of the at least one strip of collation tape inhibits lateral movement of the staple with respect to the longitudinal axis of the passage, when the staple is driven along the passage.

Also disclosed is an assembly of staples, the staples comprising a crown portion having at least two legs extending therefrom and one or more barbs protruding from at least one of the legs, the assembly further comprising at least one strip of collation tape, wherein the staples are collated and connected by way of the at least one strip of collation tape secured to the staples.

In some forms, the at least one strip of collation tape is secured to legs of the staples at a location between the respective crowns and the one or more barbs of the staples.

In some forms, each of the legs of the plurality of staples includes one or more barbs which project outwardly from the legs.

In some forms, the barbs may have a flat, square or round tip.

Also disclosed is a barbed staple comprising: a crown; two legs extending from the crown; and one or more barbs protruding from the legs; wherein the staple further comprises at least one guiding element secured to at least one of the legs at a location between the respective barb of the leg and the crown.

In some forms, the at least one guiding element is a portion of collation tape.

Also disclosed is a method of driving a barbed staple into a workpiece, the method comprising: locating a barbed staple in a nosepiece of a powered tool; and driving the staple along a longitudinal axis of the nosepiece and into the workpiece under operation of a driver blade of the powered tool; wherein an engagement portion of the driver blade is configured to provide lateral support to the staple as it is driven along the longitudinal axis of the nosepiece.

Also disclosed is a method of driving a barbed staple into a workpiece, the method comprising: locating a barbed staple in a nosepiece of a powered tool, the barbed staple being in the form having a crown; two legs extending from the crown; and one or more barbs protruding from the legs; wherein the staple further comprises at least one guiding element secured to at least one of the legs at a location between the respective barb of the leg and the crown; and driving the staple along a longitudinal axis of the nosepiece and into the workpiece under operation of a driver blade of the powered tool; wherein the guiding element inhibits lateral movement of the staple with respect to the longitudinal axis when it is being driven.

When compared to manual methods, the use of a power tool for driving a staple into a workpiece (e.g. a post, bench, wall etc.) can be both quicker and easier. This can be especially true with regards to barbed staples, which can offer more resistance against insertion into a workpiece. Moreover, a power tool may provide greater precision and control over the placement and depth of a staple in a workpiece. For example, a power tool may provide the precision required when driving a staple across a fence wire in order to avoid damage to the fence wire. Additionally, use of a power tool instead of a manual method reduces the manual labour required by a user, which may in turn reduce repetitive strain injuries and operator fatigue.

To accommodate for the barbs in the staple legs, adequate clearances need to be provided in the nosepiece of the tool for both loading and passage of the staple through the nosepiece. These clearances increase the likelihood that the staple may twist or move laterally in the nosepiece which may result in jamming of the staple in the nosepiece. To compensate for this, the tool may include arrangements to maintain the staple alignment. These may include modification of the engagement portion of the driver blade to laterally support the staple, including a guide arrangement for maintain alignment of the driver blade and maintaining close support of the staple in the proximal portion of the nosepiece, and using guiding elements on the legs of the staples to assist in maintaining this close support.

Figure 1B:
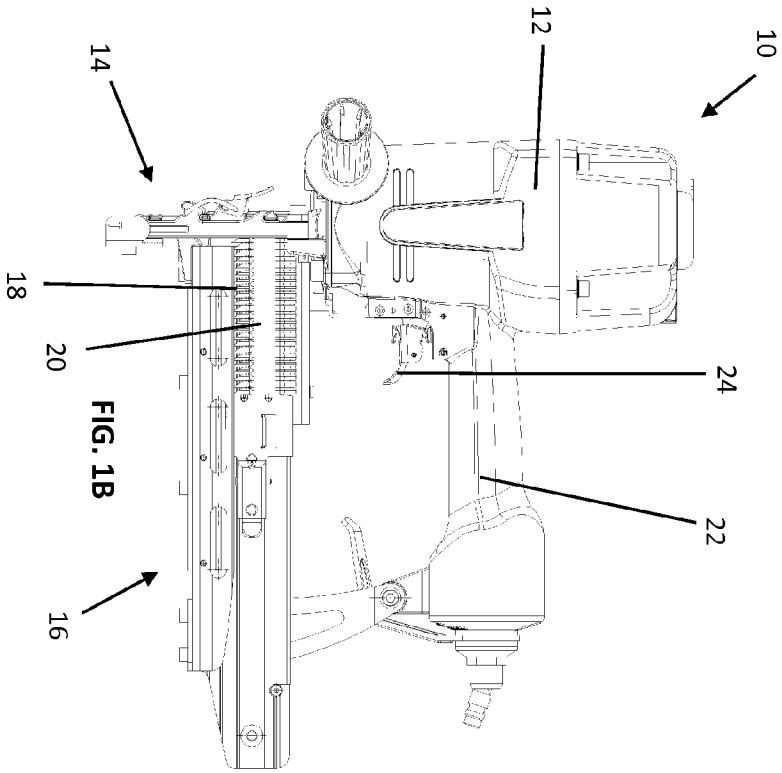

FIGS. 1*a* and 1*b* show an embodiment of a tool 10 for driving a barbed staple into a workpiece. The tool 10 comprises a housing 12 containing a power delivery source (not shown). In the illustrated form, the tool is pneumatic (i.e. powered pneumatically). In other embodiments the tool may be, for example, gas powered. A person of ordinary skill in the art would understand that other means for powering a tool would also be suitable.

The tool 10 further comprises a nosepiece assembly 14 extending from a lower end of the housing 12. A staple supply assembly, in the form of a magazine 16, extends laterally from the nosepiece assembly 14. FIG. 1*b* shows the magazine 16 holding staples 18, while in FIG. 1*a*, the magazine 16 is empty. The magazine 16 supplies collated staples 18 to a loading chamber of the nosepiece assembly 14. In the illustrated form of FIG. 1*b*, the staples 18 are collated by way of collation tape 20. In other forms, the staples 18 may be collated by way of adhesive, or alternatively may not be collated (i.e. they may be provided individually).

A hand grip 22 extends from the housing 12 and is configured such that a user may comfortably handle the tool 10. Adjacent the hand grip 22 is a trigger 24, which when pressed, activates the power delivery source such that a staple (loaded in the nosepiece assembly 14) may be driven into a workpiece by the tool 10. As a safety measure a lower workpiece contact 48 disposed at a distal end of the nosepiece assembly 14 may need to be retracted to allow activation of the power delivery source.

Figure 2:
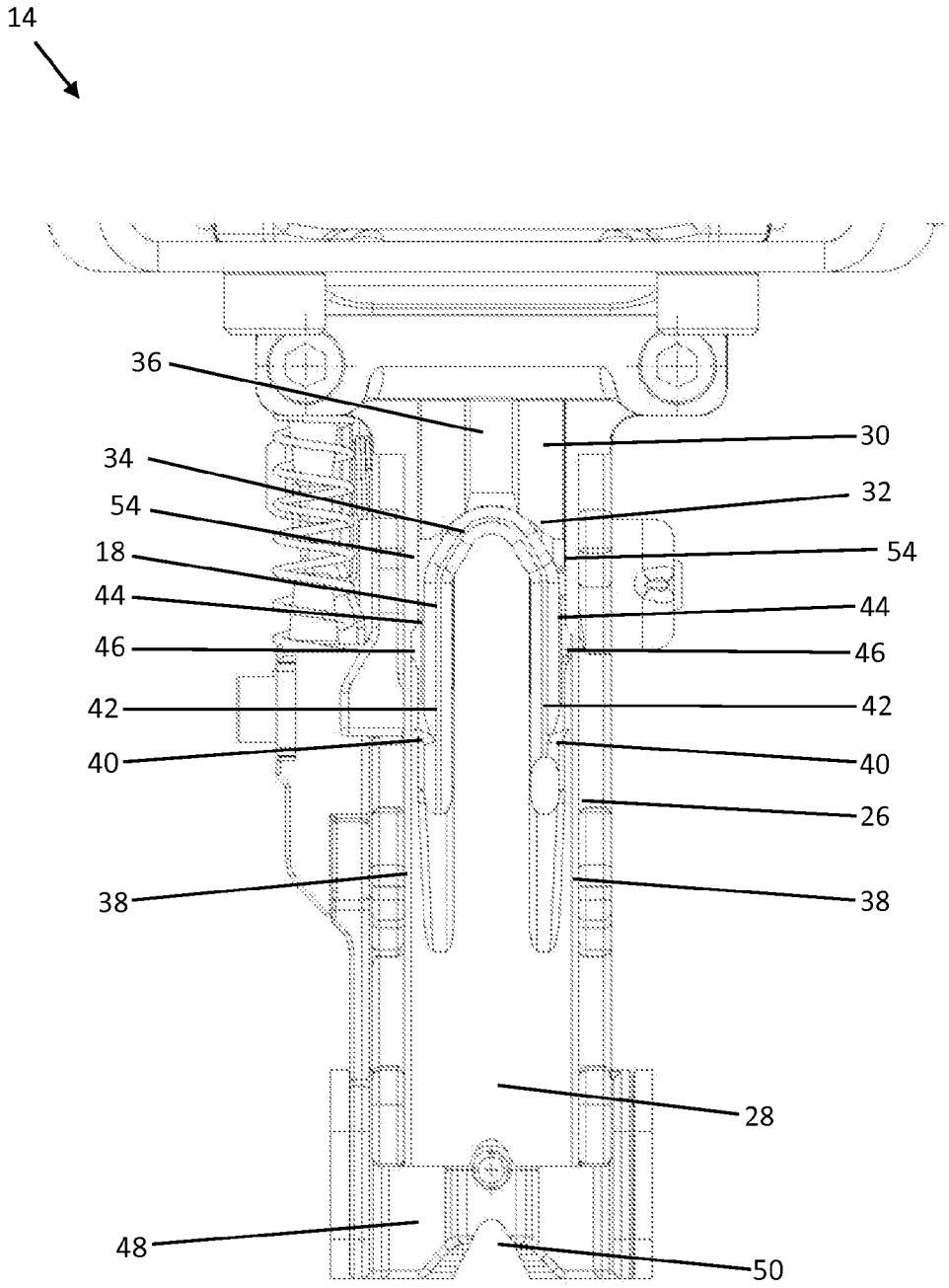
FIG. 2 is a section view of a nosepiece assembly of the tool of FIGS. 1*a* and 1*b*, FIGS. 3*a* and 3*b* are a front and side view respectively of a driver assembly of the tool of FIGS. 1*a* and 1*b*.

Referring to FIG. 2, a section of the nosepiece assembly 14 is shown. The nosepiece assembly 14 comprises a nosepiece 26 having a passage 28 along which a driver blade 30 is arranged to travel. In FIG. 2, a staple 18 is located partway down the passage 28 in the nosepiece 26 and is in contact with the driver blade 30 which is designed to push the staple through the nosepiece passage 28.

The tool further comprises a power delivery source (not shown) that is arranged to drive the driver blade 30 down the passage 28 (i.e. towards the distal end of the nosepiece 26 that is located at the workpiece). The driver blade 30 (which is described in more detail below with reference to FIGS. 3A and 3B) comprises an engagement portion 32 that engages the crown 34 of a staple 18 that has been loaded into the passage 28, to drive the staple 18 down the passage 28. In this way, the staple 18 may be driven into and secured in a workpiece.

The staple 18 comprises barbs 40 extending outwardly from the staple legs 42, thereby increasing the overall width of the staple 18. The barbs 40 of the staple 18 as shown comprise a truncated point such that the tips of the barbs 40 are flat (i.e. square) so that they are less likely to come in contact, or sustain damage from contact, with the nosepiece when the staple 18 is driven in the passage 28.

Typically the staple 18 comprises a hot dip galvanization coating, which may provide the staple 18 with rust resistance. A person of ordinary skill in the art would understand that other, or additional, coating or treatment may be applied to the staple such as e.g. electro-galvanization, heat treatment, phosphate etc.

The staple 18 further comprises tape 44 attached to each of its legs 42. The thickness of the tape 44 may be such that it assists in positioning and/or guiding the staple in the nosepiece as will be explained in more detail below.

Figure 4:
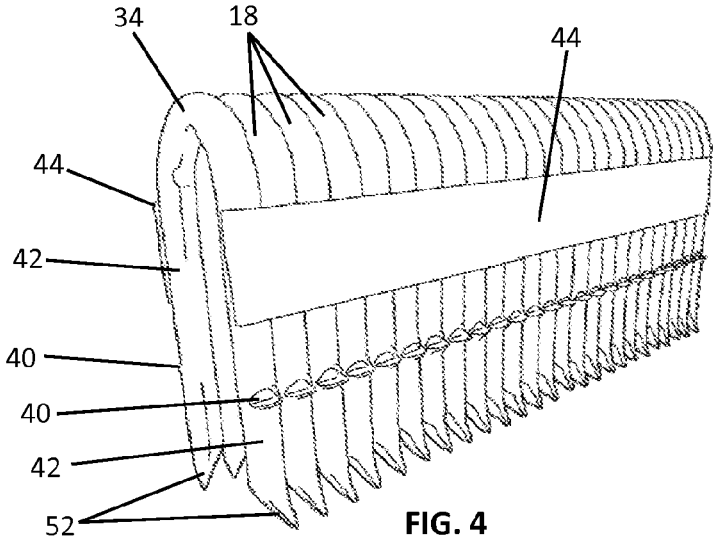
FIG. 4 is a perspective view of an assembly of collated staples that may be suitable for use with an embodiment of the tool.

The tape 44 may, for example, be a portion of collation tape that remains on the staple when it is broken away from a collated staple arrangement. Such a collated arrangement is shown in FIG. 4. In this way, the tape would be 'dual purpose', in that it would first provide for collating the assembly of staples, and secondly provide stability of a staple 18 in the passage 28 when driven by forming a wadding barrier. The tape may alternatively be applied individually to the staple (i.e. such that it is not a portion of collation tape applied to an assembly of collated staples). In one form the tape 44 may be formed of paper, however a person of ordinary skill in the art would understand that the tape may be formed of other suitable materials such as plastic. In addition, the collation tape may protect the staple leg and wire coating and barb from damage.

In the illustrated form the collated staple arrangement is loaded in the magazine 16 and supplies staples 18 to the loading chamber of the nosepiece 26 via an access aperture in the nosepiece 26. The aperture comprises means to provide access for the barbs 40 of the staple 18. In the illustrated form, the means is in the form of lateral passages 46, which provide clearance for the barbs 40 on the staples 18 when loaded from the magazine 16. Furthermore to allow for passage of the staple 18 through the nosepiece 26, clearance spaces in the form of channels 38 are provided along the walls defining the passage 28. These channels extend from the lateral passages 46 to the distal end of the nosepiece 26.

The workpiece contact element 48, in the form of a foot, is located at the lower end of the nosepiece 26. The foot 48 is configured to retract, in use, as it contacts the workpiece. That is, the foot 48 will retract back up the nosepiece 26 when a user pushes the end of the tool 10 against a workpiece in order to allow the power delivery source of the tool 10 to be activated for driving of a staple into 18 the workpiece (under operation of the tool trigger). A slot 50 is located in the base of the foot 48 and aligned such that it is perpendicular to the longitudinal axis of the crown 34 of the staple 18, and such that it is located between the legs 42 of the staple in use. Thus in use, a user can align, for example, a fence wire in the slot 50 in order to ensure that the legs of a staple 18 will be driven into the workpiece either side of the wire. This helps to prevent a user from accidentally aligning the tool 10 such that a leg 42 of the staple 18 is driven into the wire, which could cause damage to the wire or any surface treatment applied to the wire. Thus, the slot 50 may help to ensure that the durability of the wire being attached to a workpiece is not compromised (e.g. due to rust).

Because of the existence of the channels 38 and the lateral passages 46 (both of which are provided to cater for the barbs 40 on the staples 18), the tool 10 includes various means to support and/or maintain alignment of the staple in the nosepiece. As mentioned above, the outer surface of the tape is in contact, or close to being in contact, with the surface of the passage 54 disposed proximal of the lateral passages 46. Such an arrangement may provide a closer fit of the upper portion of the staple 18 in the passage 28. This may help to correctly position the staple in the nosepiece to receive the driver blade and to stabilise the motion (i.e. by limiting motion of the staple to the longitudinal axis of the passage 28) of the staple 18 when it is initially driven by the driver blade 30 down the passage 28.

To further assist in maintaining the position of the staple 18 in the nosepiece, the drive blade 36 may be modified to provide lateral support for the staple.

Figure 3A:
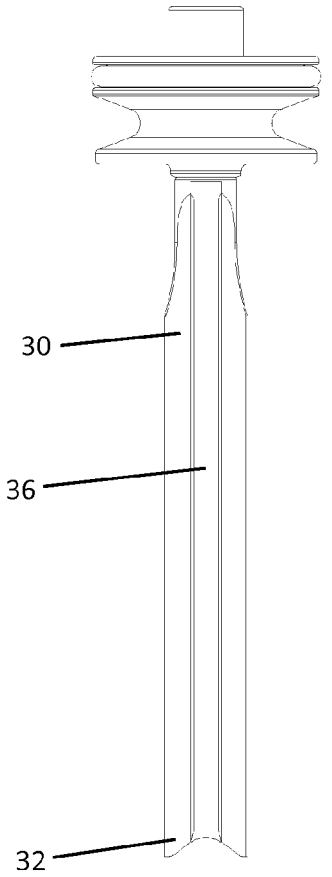
Figure 3B:
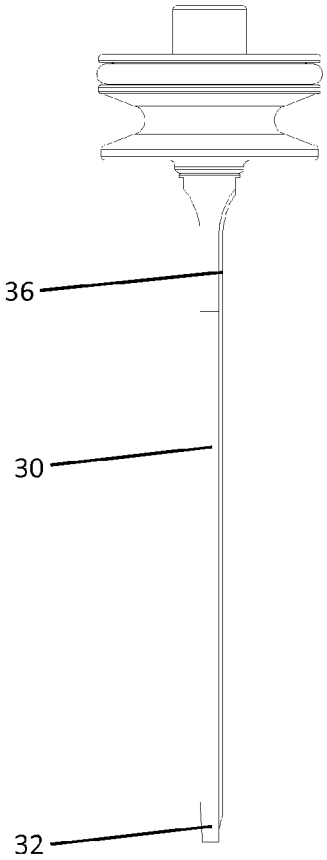

FIGS. 3A and 3B provide front and side views respectively of the driver assembly of the embodiment of the tool 10. The driver assembly comprises a driver blade 30 having an engagement portion 32 and ridge 36.

The engagement portion 32 is crescent shaped, such that it conforms to the form of the crown 34 of the staple 18. Such a configuration may allow the engagement portion 32 to guide the staple 18 in the passage 28 and prevent movement of the staple 18 away from the longitudinal axis of the passage 28 (e.g. rotation or lateral movement of the staple 18 in the passage 28). In other words, receipt of the crown 34 of the staple 18 in the concave engagement portion 32 helps to self-centre the staple 18 whilst it is being driven. In use, the power delivery source can be configured such that the driver blade 30 is accelerated as it engages the staple 18 and drives the staple 18 into the workpiece. In this respect, the staple will be held in the crescent (i.e. in continuous contact) throughout the driving action of the driver blade 30 (i.e. from engagement with the driver blade to the staple being embedded in a workpiece).

The crescent shaped engagement portion 32 may also reduce or eliminate damage to any coating that may be applied to the staple 18. This may especially be the case when compared to manual methods of driving a staple 18 into a workpiece (e.g. hand hammer driven).

The driver blade 30 also comprises a ridge 36. This ridge 36 is arranged to align and engage with a corresponding slot (not shown) located on the nosepiece 26. This engagement aligns the driver blade 30 in the passage 28, such that when it is driven, it is substantially restricted to motion along the longitudinal axis of the passage. In the absence of complete side support (i.e. due to the passage 28 comprising channels 38) the ridge 36 may provide partial or full stability to the driver blade 30 during driving action.

Now referring to FIG. 4, the assembly of staples 18 for use with the embodiment of the tool is shown. Each staple comprises a crown 34, two legs 42 and a barb 40 on each leg 42. The staples 18 are collated and connected by paper collation tape 44 applied to the legs 42 of the staples 18. Each staple 18 comprises diverging points 52, which have opposing angled faces such that when a staple 18 is driven into a workpiece, the legs 42 are caused to diverge. As discussed above, the collation tape 44 not only secures the collated staples together but can assist in maintaining alignment of the staple 18 in the nosepiece 26 by providing a closer fit of the upper portion of the staple 18 in the passage 28.

To allow for reliable operation of the staple tool, the dimensions of the staples 18 and their alignment in the collated assembly need to be within relative tight tolerances which may be in the order of ±5 mm. Also the adhesion of the collation tape and its properties influence the operation of the tool. In one form, the staples are manufactured and collated to meet the desired criteria using a process whereby the staples are made using a pressing operation including a 3 stage bending process. During this pressing operation the barbs are formed on the staple legs. The staples then pass onto a staple collation rail where the stables are heated to approximately 300° C. The collation tape (which in one form may be a paper based tape supplied under the trade name PASLODE PRO-STRIP EQ98) is applied to the heated staples where a bond is formed between the collation tape and the metal surface of the staples.

Accordingly a powered staple tool 10 is provided that uses barbed staples 18 which may be in supplied in a collated assembly. This allows for rapid and effective fixing of the staples and is ideal for applications such as fencing. To accommodate for the barbs in the staple legs, adequate clearances are provided in the nosepiece of the tool for both loading and passage of the staple through the nosepiece. As these clearances increase the likelihood of the staple twisting or moving laterally in the nosepiece (which may result in jamming of the staple in the nosepiece), support arrangements are provided to maintain correct positioning of the staple in the nosepiece.

In the claims which follow and in the preceding summary except where the context requires otherwise due to express language or necessary implication, the word "comprising" is used in the sense of "including", that is, the features as above may be associated with further features in various embodiments.

Variations and modifications may be made to the parts previously described without departing from the spirit or ambit of the disclosure.

The invention claimed is:

1. A tool for driving a barbed staple into a workpiece, the barbed staple including a crown, two legs extending from the crown, and a barb extending outwardly from each leg such that a width of the barbed staple is greater than a width of the crown, the tool comprising:

a housing enclosing a power delivery source;

a driver blade drivable by the power delivery source and comprising an engagement portion configured for engagement with the barbed staple; and a nosepiece defining an aperture providing access for loading the barbed staple into the nosepiece, the aperture including two opposing lateral passages arranged to provide clearance for the outwardly extending barbs on the respective legs of the barbed staple, the nosepiece further defining a passage in which the driver blade is slidably mounted such that, in use, the driver blade is drivable along a longitudinal axis of the passage by the power delivery source to engage and drive the barbed staple into the workpiece;

wherein the nosepiece defines two spaced-apart longitudinally extending channels sized to enable passage for the barbs of the barbed staple when the barbed stable is driven by the driver blade.

2. The tool of claim 1, further comprising a workpiece contact element slidably mounted on the nosepiece and configured to retract upon being pressed against the workpiece.

3. The tool of claim 2, wherein the workpiece contact element defines a groove, the groove aligned such that, in use, when the barbed staple is driven into the workpiece, the legs of the barbed staple will be located on either side of the groove.

4. The tool of claim 3, wherein the groove is configured for receipt of a fence wire.

5. The tool of claim 1, further comprising a staple supply mechanism for supplying staples into the nosepiece through the aperture.

6. The tool of claim 5, wherein the staple supply mechanism is arranged to receive a plurality of collated barbed staples.

7. The tool of claim 1, wherein the channels extend from the aperture to a workpiece contact element slidably mounted on the nosepiece.

8. A tool for driving a barbed staple into a workpiece, the tool comprising:

a housing enclosing a power delivery source;

a driver blade drivable by the power delivery source and comprising an engagement portion configured for engagement with the barbed staple; and a nosepiece defining an aperture providing access for loading the barbed staple into the nosepiece, the nosepiece further defining a passage in which the driver blade is slidably mounted such that, in use, the driver blade is drivable along a longitudinal axis of the passage by the power delivery source to engage and drive the barbed staple into the workpiece;

wherein the driver blade comprises a ridge formed along a longitudinal axis of the driver blade, the ridge being slidably engaged with a corresponding recess defined in the nosepiece, the ridge being configured to resist lateral movement of the driver blade with respect to the longitudinal axis of the passage; and wherein the engagement portion of the driver blade includes opposing ends and a portion between and recessed relative to the ends such that the engagement portion can provide lateral support to the barbed staple as it is driven along the longitudinal axis of the passage.

9. The tool of claim 8, wherein the engagement portion of the driver blade is concave to conform to a crown of the barbed staple.

10. A tool for driving a barbed staple into a workpiece, the barbed staple including a crown, two legs extending from the crown, and a barb extending outwardly from each leg such that a width of the barbed staple is greater than a width of the crown, the tool comprising:

a housing enclosing a power delivery source;

a driver blade drivable by the power delivery source and comprising an engagement portion configured for engagement with the barbed staple;

a nosepiece defining: (a) an aperture providing access for loading the barbed staple into the nosepiece, (b) a passage in which the driver blade is slidably mounted such that, in use, the driver blade is drivable along a longitudinal axis of the passage by the power delivery source to engage and drive the barbed staple into the workpiece, and (c) two spaced-apart longitudinally extending channels sized to enable passage for the barbs of the barbed staple when the barbed stable is driven by the driver blade; and a workpiece contact element slidably mounted on the nosepiece and configured to retract upon being pressed against the workpiece, the workpiece contact element defining a groove, the groove aligned such that, in use, when the barbed staple is driven into the workpiece, the legs of the barbed staple will be located on either side of the groove.

11. A tool for driving a barbed staple into a workpiece, the barbed staple including a crown, two legs extending from the crown, and a barb extending outwardly from each leg such that a width of the barbed staple is greater than a width of the crown, the tool comprising:

a housing enclosing a power delivery source;

a driver blade drivable by the power delivery source and comprising an engagement portion configured for engagement with the barbed staple; and a nosepiece defining an aperture providing access for loading the barbed staple into the nosepiece, the nosepiece further defining a passage in which the driver blade is slidably mounted such that, in use, the driver blade is drivable along a longitudinal axis of the passage by the power delivery source to engage and drive the barbed staple into the workpiece;

wherein the nosepiece defines two spaced-apart longitudinally extending channels sized to enable passage for the barbs of the barbed staple when the barbed stable is driven by the driver blade, the channels extending from the aperture to a workpiece contact element slidably mounted on the nosepiece.

* * * * *